US006373956B1

(12) United States Patent
Varla et al.

(10) Patent No.: US 6,373,956 B1
(45) Date of Patent: Apr. 16, 2002

(54) METHOD AND ARRANGEMENT FOR ATTENUATING MECHANICAL RESONANCE IN A LOUDSPEAKER

(75) Inventors: Ari Varla, Iisalmi; Aki Mäkivirta, Lapinlahti, both of (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 09/190,175

(22) Filed: Nov. 12, 1998

(30) Foreign Application Priority Data

Nov. 12, 1997 (FI) ..... 974217

(51) Int. Cl.[7] ..... H04R 25/00
(52) U.S. Cl. ..... 381/353; 381/354; 181/208
(58) Field of Search ..... 381/353, 412, 381/413, 354, 421, 71.2; 181/208, 209

(56) References Cited

U.S. PATENT DOCUMENTS 4,176,249 A 11/1979 Inanaga et al.
4,598,178 A 7/1986 Rollins
4,675,907 A 6/1987 Itagaki et al.
4,710,656 A * 12/1987 Studer ..... 310/51
4,720,868 A * 1/1988 Hirano ..... 381/182
4,724,923 A * 2/1988 Waterman ..... 181/208
5,850,460 A * 12/1998 Tanaka et al. ..... 381/186
6,195,442 B1 * 2/2001 Griffin et al. ..... 381/412

FOREIGN PATENT DOCUMENTS

DE 3037227 A1 4/1982

* cited by examiner

*Primary Examiner*—Sinh Tran
*Assistant Examiner*—P. Dabney
(74) *Attorney, Agent, or Firm*—Birch, Stewart, Kolasch & Birch, LLP

(57) ABSTRACT

The present invention concerns the reduction of vibrations of a loudspeaker enclosure caused by the mechanical vibrations of the dynamic loudspeaker element by virtue of attaching one or more additional masses to the loudspeaker driver unit using elastic and lossy means. The masses with their elastic attachments dimensioned according to the present invention resonate at frequencies excited by the vibrations of the loudspeaker element at frequencies where the reduction of the amount of vibration is desired. The magnitude of vibration coupled to the enclosure of a loudspeaker modified according to the present invention is significantly smaller than that of a conventional loudspeaker. Furthermore, it is technically and economically advantageous to implement the reduction of mechanical vibrations according to the present invention.

20 Claims, 6 Drawing Sheets

METHOD AND ARRANGEMENT FOR ATTENUATING MECHANICAL RESONANCE IN A LOUDSPEAKER

BACKGROUND OF THE INVENTION

1. Field of the Invention

The invention relates to a method and arrangement for attenuating mechanical resonance in a loudspeaker.

2. Description of the Relevant Art

For about 50 years, it has been known in the art that mechanical resonances in a loudspeaker decrease the quality of emitted sound, and various methods have been devised to overcome the problem. A plurality of these draw upon elastically mounting the loudspeaker element to the enclosure, thus attenuating the transmission of vibrations to the enclosure. However, such structures proposed in many different embodiments are difficult to implement, expensive to produce and require the design and manufacture of nonstandard means of mounting the loudspeaker element.

Thomasen [1] and [5] have patented a vibration damper suitable for attachment to the enclosure wall, with the aim of reducing vibrations in enclosure walls. Because this method does not attempt to reduce the exciting vibration at its source, but rather, the secondary effects of wall motion, it fails to provide an effective approach to control vibration. Furthermore, it is a general object in the art to control vibrations over a wide bandwidth, whereby it can be shown that the disclosed embodiment is incapable within the constraints of practicable designs and materials to combine wide-band operation with high efficiency.

Akroyd [2] presents a construction wherein a tube made of an elastic material couples mechanically the dynamic loudspeaker element to the enclosure wall. This arrangement aims to support the frame of the loudspeaker element to reduce vibrations. At the same time, the tube acts as an acoustical resonant structure. While providing mechanical support, the structure fails to act as an efficient attenuator of enclosure resonances. The invention claims that this mechanical coupling achieves cancellation of vibrations, and thereby a reduction thereof. It is known that as the stiffness of material can be increased, e.g., by additional supporting, the eigenfrequencies of characteristic resonances increase, but the resonances are not removed unless the frictional losses of the structure that cause attenuation of resonances cannot be simultaneously increased. In fact, if the driver unit of a dynamic loudspeaker element is coupled mechanically to the rear wall of an enclosure, the amount of mechanical vibrations in the external walls of the loudspeaker enclosure are actually likely to increase rather than to decrease, because this construction actually enhances the mechanical coupling of vibrations at most frequencies, instead of reducing the coupling. However, one effect of the additional mechanical support is to move the eigenfrequencies of mechanical resonances to higher frequencies.

Tanaka [3] presents a construction where the driver unit of a dynamic loudspeaker element is fixed to some external part of the loudspeaker enclosure other than its front wall. Additionally, there is provided an elastic means of fixing the frame of the loudspeaker element to the loudspeaker enclosure. The comments expressed about reference [2] apply equally well to this invention, because again there is provided a construction wherein the loudspeaker driver unit is mechanically attached to the enclosure using means having low mechanical losses, although herein the fixing point is not on the front of the enclosure. Because vibrations that are coupled to the enclosure walls normally occur on all walls of the enclosure, this invention will not lead to a good end result. No matter to which wall the driver unit of the loudspeaker element has been attached, mechanical vibrations will appear in all walls of the enclosure, and the transmission of mechanical energy to the enclosure becomes particularly efficient at a frequency where the mechanical elasticity of the attachment means and the mass of the loudspeaker element will resonate. Therefore, the invention cannot generally reduce the coupling of vibrations to the enclosure, although it may marginally reduce vibrations that are coupled to the front wall of the enclosure.

The invention disclosed by Favali [4] presents a loudspeaker enclosure with a construction that aims to attenuate mechanical vibrations by using plates made of an elastomer that bond together the walls of the enclosure and attach the loudspeaker element to the enclosure. The goal herein is to create shear forces into the elastomer that serves to convert mechanical energy into heat by internal friction in the material. This invention does not attempt to reduce the tendency of the loudspeaker element to cause mechanical vibrations. The structure is not efficient at resonant frequencies whose maximum displacement does not occur at the elastomer joints because there is no acoustic energy loss at these frequencies in the elastomer material.

It is typical of the prior-art solutions [1–5] that there is no attempt to control the mechanical vibration at its source, i.e., at the loudspeaker element, but rather they pursue to affect the secondary vibrations in the loudspeaker enclosure.

SUMMARY OF THE INVENTION

The present invention differs from the prior art in that it is a particular object of the invention to attenuate the mechanical vibration of the loudspeaker element driver unit, thereby making it unnecessary to attenuate vibrations in the enclosure structures. In this way, the present invention is different from and already basically superior to conventional constructions.

The goal of the invention is attained by elastically attaching at least one additional mass to the magnet circuit of the loudspeaker, with the masses chosen such that the eigenfrequencies of the system will typically coincide with the mechanical resonances of the loudspeaker. With this provision, the mechanical vibration energy produced by the magnet circuit tends to become transferred to the additional masses as a vibration of the additional masses, thus allowing the elastic coupling elements to absorb this energy by the frictional losses of the material. Typically, the total additional mass is chosen to be of the same order of magnitude as the mass of the magnet circuit. The masses may also differ by their order of magnitude from the mass of the magnet circuit.

The invention offers substantial benefits.

Control of resonance attenuation by the virtue of the present method is cheaper to implement than by using the prior-art techniques, because it is not necessary to modify the good and well-proven principles of loudspeaker construction in order to remove undesirable resonances. This is not possible if the loudspeaker element is attached to the enclosure using elastic means, if the magnet circuit is elastically attached to the frame of the loudspeaker element, or when using elastic structures in the loudspeaker enclosure. Furthermore, by a proper choice of the additional masses and the elasticity and losses in their attachment, it is possible to adjust the Q-value of the resonance peaks, the effective frequency range of control and the amount of vibration reduction.

BRIEF DESCRIPTION OF THE DRAWINGS

In the following, the invention will be described in more detail with reference to the exemplifying embodiments illustrated in the attached drawings in which.

DETAILED DESCRIPTION OF THE INVENTION

Figure 1:
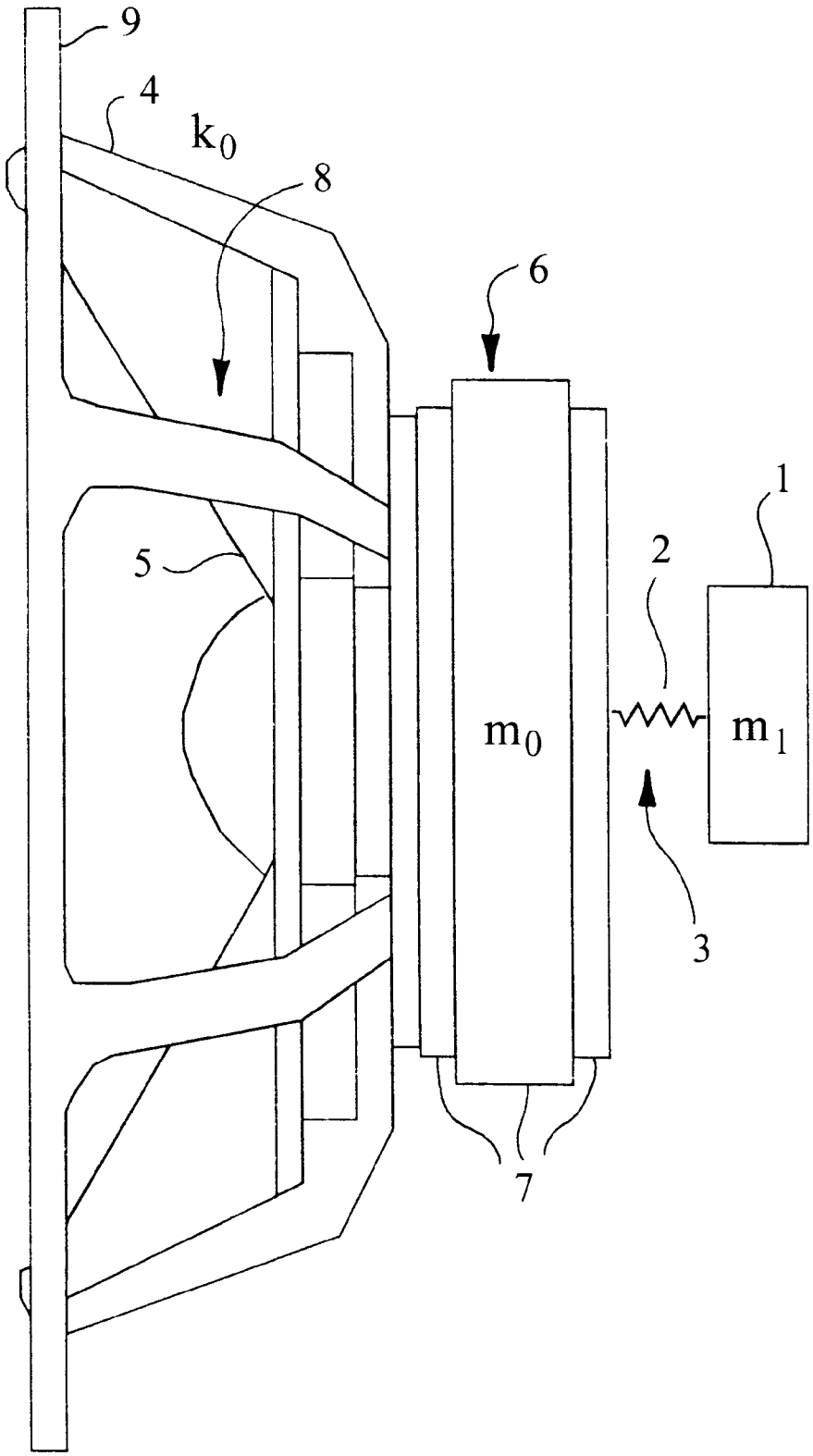
FIG. 1 shows a side view of a loudspeaker structure according to the invention using one elastically attached additional mass.
Figure 2:
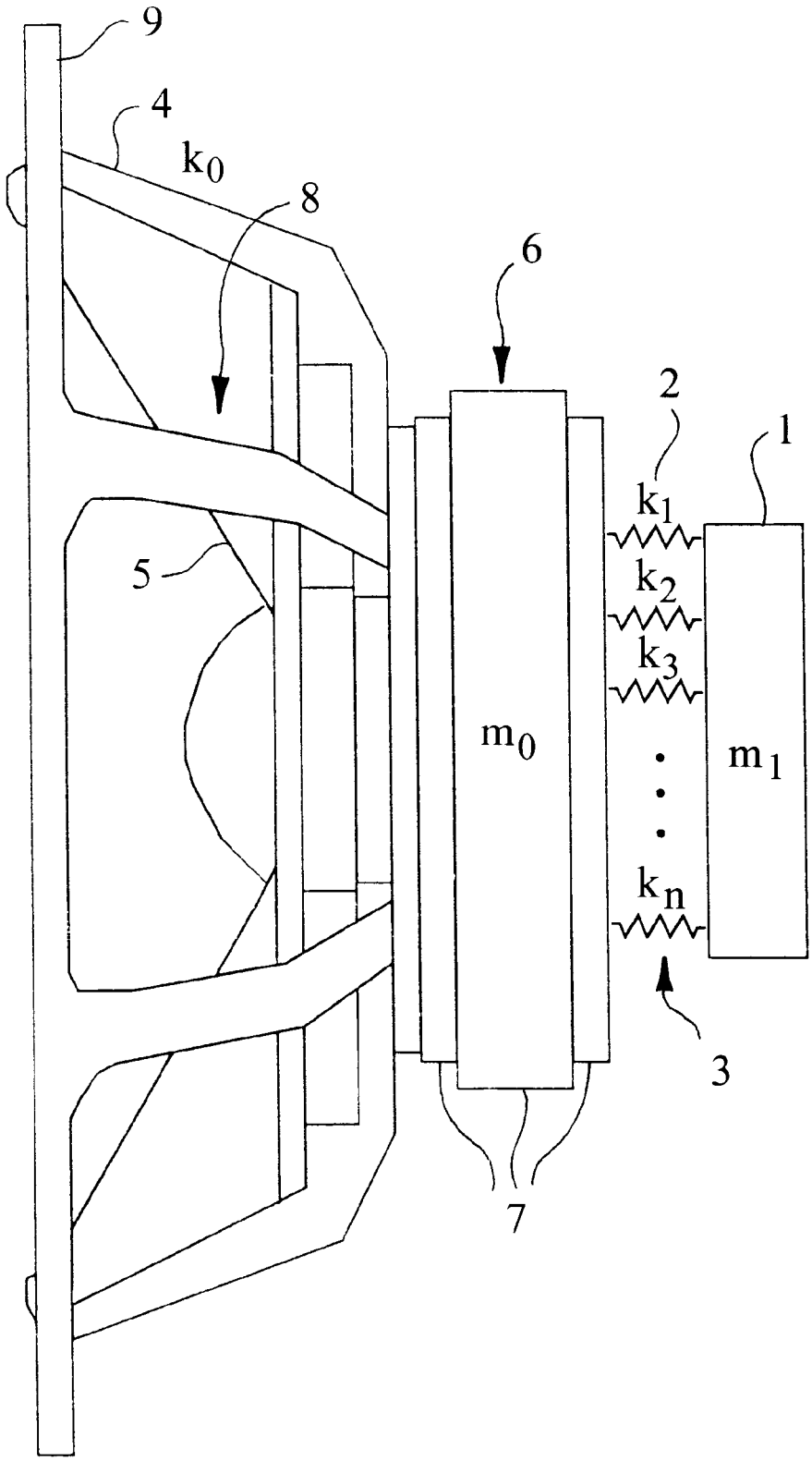
FIG. 2 shows a side view of a loudspeaker structure according to the present invention using one additional mass attached by several elastic attachments effectively connected in parallel.
Figure 3:
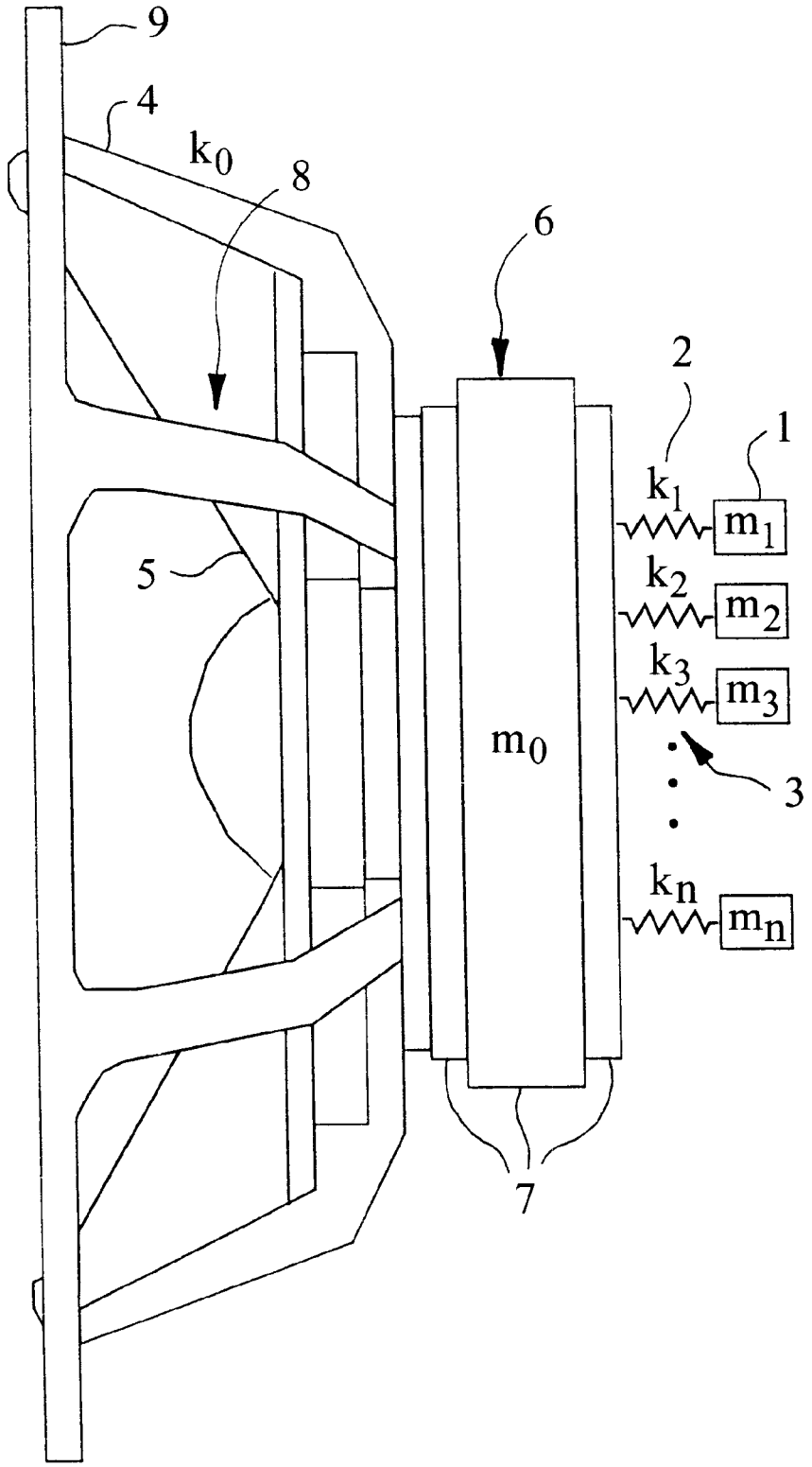
FIG. 3 depicts a side view of a loudspeaker structure according to the invention using a number of elastically attached additional masses effectively connected in parallel.
Figure 4:
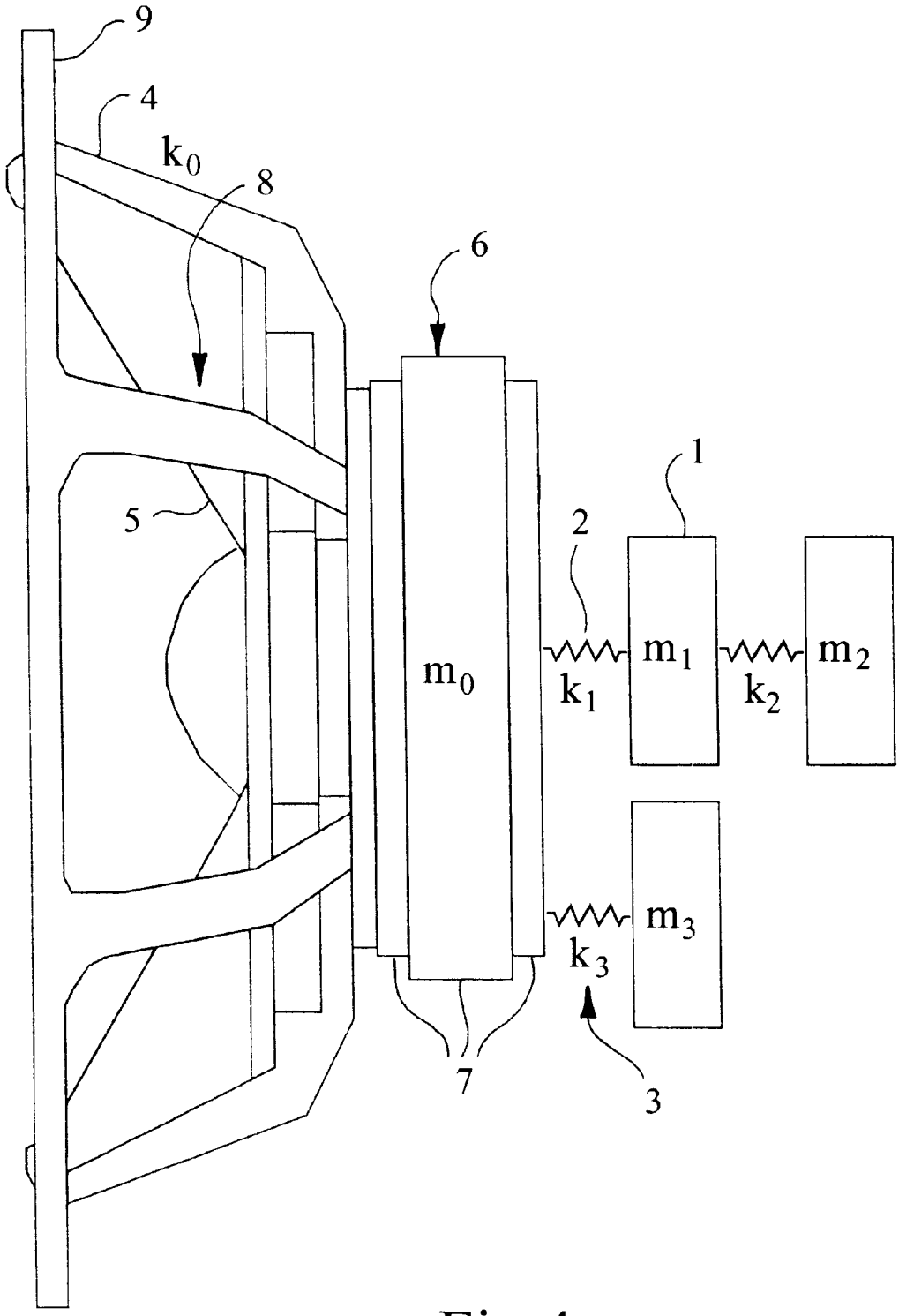
FIG. 4 shows a side view of a loudspeaker structure according to the invention using a number of elastically attached additional masses effectively connected in a serial and a parallel fashion.

Referring to FIG. 1 a dynamic loudspeaker element shown therein includes a driver unit 6 that, under actuation by an electromagnetic force, displaces a radiating element 5, typically a cone. Typically, the driver unit is composed of a magnet circuit 7 and a voice coil (not shown) moving inside the air gap in the magnet circuit. Conventionally, the voice coil is glued to the air-displacing cone 5. In this way, the loudspeaker element comprises the mass of an air displacing mechanism 8 (i.e., the cone and voice coil) and the mass of the stationary part 7 (the magnet circuit) and the frame structure of the loudspeaker element frame 4.

The cone-displacing driver unit comprising the magnet circuit and the voice coil moving in the air gap of the magnet circuit are attached to an external structure, typically the loudspeaker enclosure, by the perimeter 9 of the loudspeaker element frame 4. The frame 4 is typically made of a steel plate, plastic or die-cast metal, and it has a certain elasticity in the direction of the voice coil displacement axis. Also the front wall of the loudspeaker enclosure has some amount of elasticity that typically can be considered to add to the elasticity of the loudspeaker element frame 4.

As the loudspeaker operates, the electromagnetic force acts on the magnet circuit in the opposite direction to the force acting on the voice coil, thus causing the elasticity in the loudspeaker element frame and any elasticity in the mechanical attachment to the front wall of the enclosure to create one or more resonances with any mass mechanically coupled to either of these. Then, the vibrational energy has favorable conditions to become transmitted from the magnet circuit into enclosure walls, causing them to vibrate. This is not favorable, and this transmission of mechanical vibration energy creates acoustical radiation from the enclosure walls that sum up with the acoustical radiation emitted by the loudspeaker element. Hence, the acoustical output is no longer determined by the loudspeaker element alone as originally intended, and the quality of the audio output will deteriorate.

For a typical loudspeaker, we can find an angular frequency $w_0$ at which the mass of the magnet circuit displacing the voice coil and any stiffly connected part of the frame will resonate with the elasticity of the frame 4. This mechanical resonance may be modelled as a lossy mass-spring system.

Figure 6:
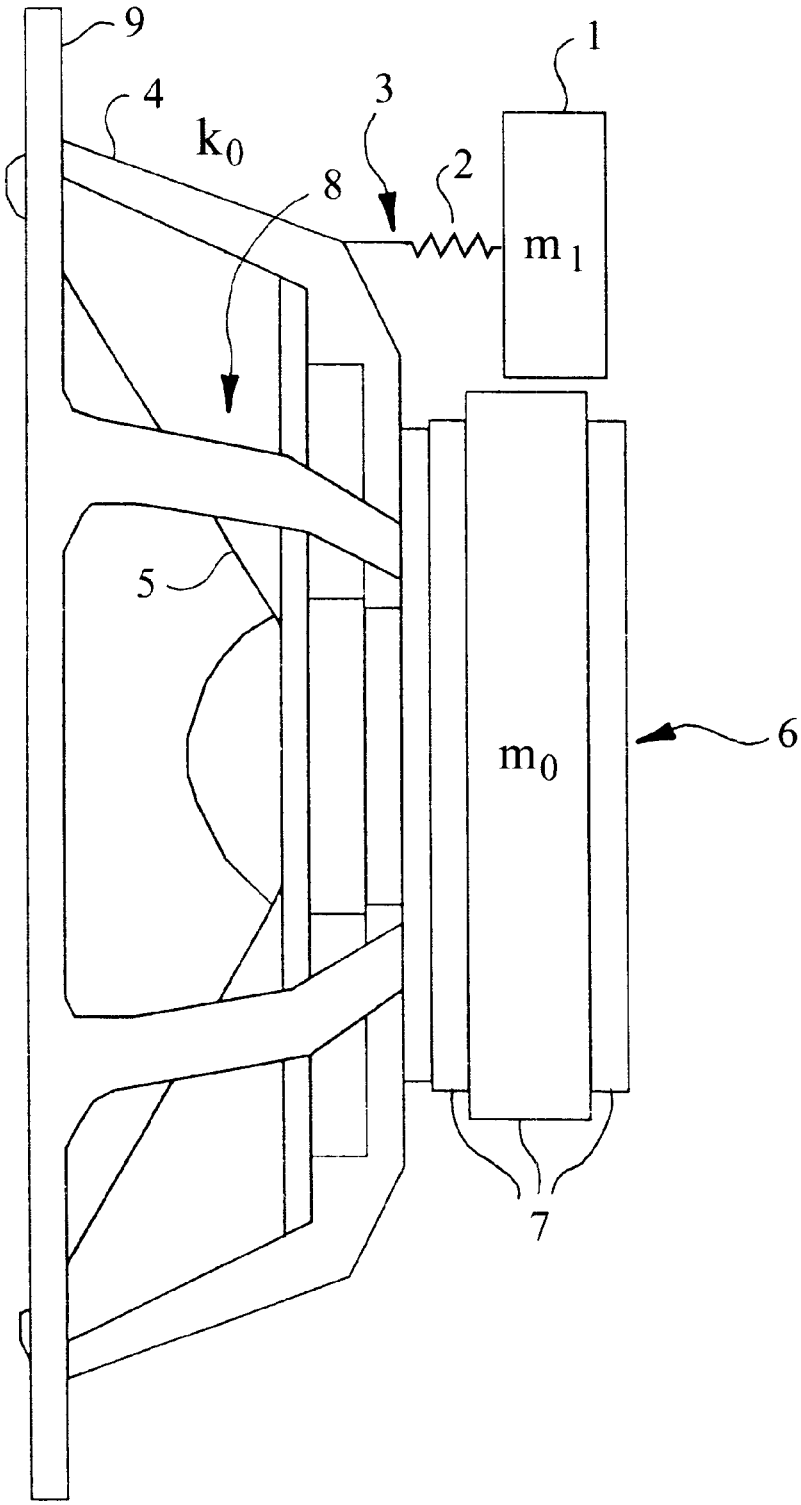
FIG. 6 shows a side view of a loudspeaker structure, according to an alternate embodiment of the invention, using one elastically attached additional mass.

The present invention discloses a method for attaching additional masses to the magnet circuit 7 (FIG. 1) or frame 4 (FIG. 6) such that the additional masses 1 will resonate with the magnet circuit 7 at frequencies that can be chosen so as to, e.g., coincide with the resonant frequency $w_0$ of the magnet circuit-frame system. Furthermore, these frequencies can be chosen to be any other frequencies at which the transmission of vibrational energy to the enclosure walls needs to be reduced. By a suitable choice of the amounts of additional masses and elasticities 3 of their attachments, it is possible to control multiple resonances at multiple frequencies or in overlapping frequency bands. In this way, it is possible to adjust and control the efficiency and the effective frequency range of the mechanical vibration reduction.

The theoretical background of the invention is as follows.

Figure 5A:
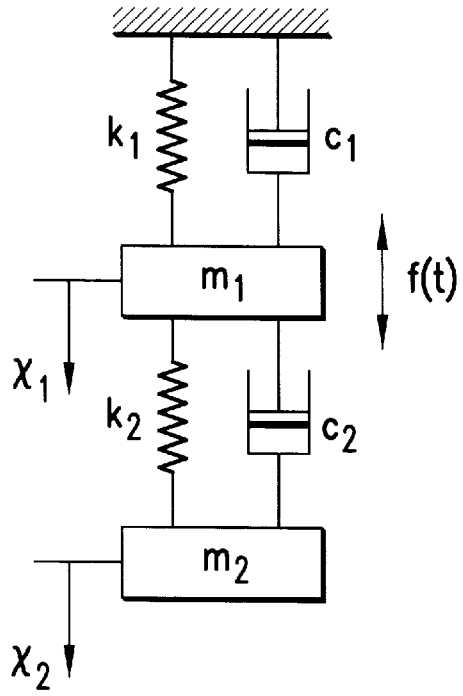
FIG. 5, shows the parameters associated with the mechanical resonance and the corresponding electromechanical analogy of the embodiment of FIG. 1.
Figure 5B:
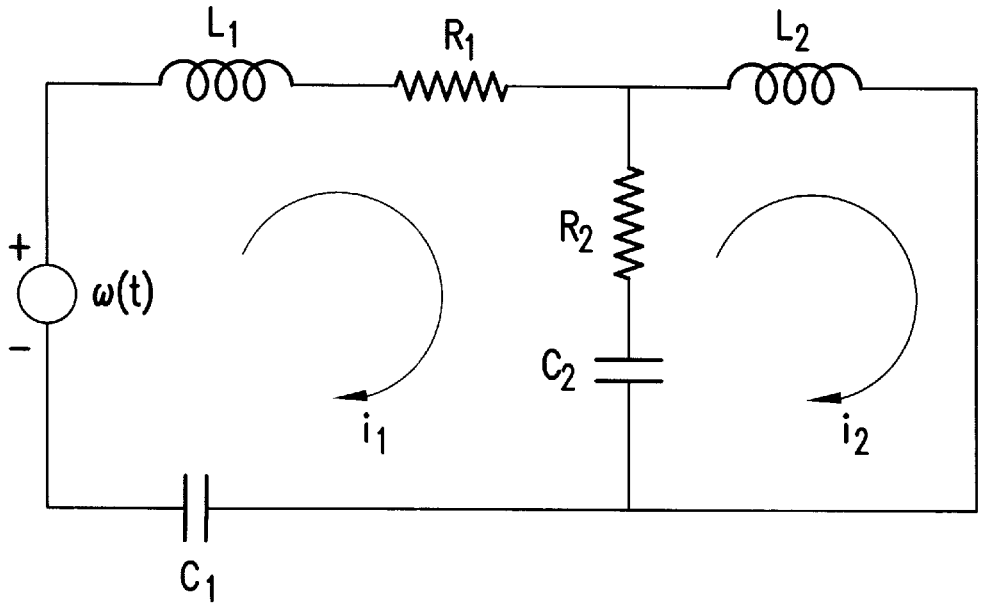

In the following discussion, reference is made to FIG. 5(*a*) depicting one elastically attached additional mass (mass $m_2$) that forms a mass-spring system with the magnet circuit $m_1$ and the stiffness of the element frame $k_1$ and its losses $c_1$. The displacement amplitude has a maximum at the resonant frequency of this system. FIG. 5 depicts a system where a mass $m_2$ with an elasticity $k_2$ and loss factor $c_2$ has been attached elastically to this system.

The resonant frequencies of this system of two coupled masses formed in this manner may be adjusted suitably by changing the elasticity $k_2$ and loss factor $c_2$ to minimize the displacement amplitude $x_1$ at the mechanical resonant frequency of the magnet circuit mass $m_2$.

Newton's second law of motion $$\Sigma F = ma \qquad \text{Eq (1)}$$

indicates that a system remains at rest if the sum of all forces acting on it are zero. The equations of motion [7] for the previous mass system, which is affected by the force of the voice coil F(t), can be written as $$m_1\frac{d^2x_1}{dt^2} + (c_1 + c_2)\frac{dx_1}{dt} + (k_1 + k_2)x_1 - c_2\frac{dx_2}{dt} - k_2x_2 = F(t) \qquad \text{Eq (2)}$$

$$m_2\frac{d^2x_2}{dt^2} + c_2\frac{dx_2}{dt} + k_2x_2 - c_2\frac{dx_1}{dt} - k_2x_1 = 0 \qquad \text{Eq (3)}$$

Using an electromechanical analogy where the mechanical force F(t) appears as voltage v(t) and the motional velocity dx/dt appears as current i(t), the electromechanical analogy depicted in FIG. 5(*b*) can be formed.

Then, the behaviour of the two-mass mechanical system can be analyzed by either using the differential equations (Eq 2) and (Eq 3) or using the electrical analogy. In the following, the behaviour of this system is examined using the electromechanical analogy.

Without an additional mass $m_2$, the mass-spring system $m_1$ formed by the above-described loudspeaker magnet circuit will oscillate with velocity v which depends on the angular velocity [6] as $$v = \frac{F_o}{\sqrt{\left(m_1\omega - \frac{k_1}{\omega}\right)^2 - c}} \quad \text{Eq (4)}$$

When not employing the additional $mass_2$, the maximum of velocity occurs at a resonant frequency where the imaginary part of the denominator becomes zero, whereby the transfer of mechanical energy is the most efficient. The angular frequency of this resonance is $$\left(m_1\omega_o - \frac{k_1}{\omega}\right)^2 = 0 \Rightarrow \omega_o = \sqrt{\frac{k_1}{m_1}} \quad \text{Eq (5)}$$

Next, the change of the situation by the use of the additional mass $m_2$ is examined. Analysis of the two-mass system of FIG. 5 using an electromechanical analogy shows that, through adjusting the resonant frequency of the additional mass, it is possible to reduce the displacement amplitude of the magnet circuit $x_1$. This resonant frequency is determined by the mass $m_2$ and the elasticity $k_2$ of its attachment, and it is adjusted to be the same as the resonant frequency of the magnet circuit.

The ability of the additional mass to reduce the motional velocity depends on losses of the elastic attachment (component $R_2$ in the electro-mechanical analogy). By adjusting losses to a right level after setting the resonant frequency to be right by using suitable materials and correct mechanical dimensioning for the elastic attachment, it is possible to reduce mechanical vibrations down to any level and obtain any desired level of vibration attenuation.

The ability of the resonator created by the additional mass to absorb kinetic energy of the driver unit is characterized by the Q-value of the resonance system. It can be shown [6] that the Q-value is $$Q = \frac{m_2\omega_o}{c_2} \quad \text{Eq (6)}$$

Equation 6 shows that at the resonant frequency $w_0$, the Q-value of the resonance and therefore, the ability to attenuate mechanical vibrations, depends on the amount of additional mass and the elasticity of its attachment to the magnet system. If the loss factor of the elastic attachment remains constant, the desired Q-value can be obtained by selecting the right amount of additional mass and right elasticity of the attaching spring. If the additional mass remains constant, the amount of losses of the attachment must be reduced as the frequency decreases.

Next, an example of determining the parameter values for a practicable embodiment of the present invention is discussed.

The value of an additional mass according to the invention can be chosen, e.g., by measuring with the help of an acceleration transducer the resonant frequency of the mass-spring system formed by the magnet circuit and the loudspeaker element frame mounted in a loudspeaker enclosure. After the resonant frequency is known, to the magnet circuit 7 is attached an additional mass having a weight approximately equal to the mass of the magnet circuit, and the measurement is repeated. By using the physical principles explained above, the correct value for the spring constant (represented by a correct loss factor and elasticity) and the mass then chosen.

An example of a system encountered in the practice of the art is represented by a loudspeaker element having a measured resonant angular frequency $w_0$ of 3300 rad/s and the magnet circuit 7 with a mass of 1.80 kg. In this case, the additional mass 1 is attached by using a spring made of nitrile rubber having a sheet thickness of 4 mm and an area of 4.5 $cm^2$. The elasticity of the material is 4.3 MN/m. The amount of additional mass in this case is chosen to be 0.4 kg. These selections produce effective reduction of vibrations. This example shows how properties of the attachment spring affect the amount of the required additional mass, and that the optimum may not be exactly the same mass as that creates the mass-resonance system in the loudspeaker, but that the mass does have the same order of magnitude. Furthermore, in some cases it is advantageous to divide the additional mass and its attachment spring into subcomponents. The mass and the elasticity may be varied according to the principles described above to reduce the effect of the mechanical resonance $w_0$ down to a desired low level.

What is claimed is:

1. A method for attenuating an audible, mechanical resonance of a loudspeaker, said method comprising the steps of:

providing a loudspeaker including a driver unit, a sound radiating element, a frame and a housing;

selecting and elastically attaching at least one additional mass to at least one of the drive unit and the frame such that the combination of the at least one additional mass and its elastical attachment has a resonant frequency substantially equal to an audible mechanical resonance of the loudspeaker; and attenuating an audible mechanical resonance of the loudspeaker by letting the additional mass freely resonate relative to the at least one of the drive unit and the frame.

2. The method according to claim 1, wherein the drive unit includes a magnetic circuit, and wherein said step of selecting at least one additional mass includes selecting at least one additional mass having a total mass of 0.1 to 10 times a mass of the magnetic circuit.

3. The method according to claim 2, wherein said step of selecting at least one additional mass includes selecting at least one additional mass having a total mass substantially equal to a mass of the magnetic circuit.

4. The method according to claim 1, wherein the drive unit includes a magnetic circuit, and wherein said step of elastically attaching the at least one additional mass to the drive unit or the frame includes elastically attaching the at least one additional mass to the magnetic circuit.

5. The method according to claim 4, wherein the at least one mass is connected to the magnetic circuit by at least one spring.

6. The method according to claim 5, wherein the at least one spring includes a plurality of springs arranged in serial between the magnetic circuit and the at least one additional weight.

7. The method according to claim 5, wherein the at least one spring includes a plurality of springs arranged in parallel between the magnetic circuit and the at least one additional weight.

8. The method according to claim 1, wherein the at least one additional mass is elastically attached to the drive unit or the frame by one or more of an elastomer, a metal spring, or an air spring.

9. The method according to claim 1, wherein the at least one additional mass is elastically attached to the drive unit or the frame by at least two springs having relatively different elasticities.

10. The method according to claim 1, wherein the at least one additional mass is elastically attached to the drive unit or the frame by at least two springs having substantially equal elasticities.

11. An arrangement for attenuating an audible, mechanical resonance of a loudspeaker system, said arrangement comprising:

a sound radiating cone;

a driver unit attached to said sound radiating cone;

a frame for supporting the sound radiating cone; and at least one additional mass elastically attached to at least one of said driver unit and said frame, wherein the combination of said at least one additional mass and its elastic attachment are selected so as to have a resonant frequency substantially equal to an audible mechanical resonance of the loudspeaker, such that letting said at least one additional mass freely resonate relative to said at least one of said driver unit and said frame attenuates an audible mechanical resonance of the loudspeaker system.

12. The arrangement according to claim 11, wherein said drive unit includes a magnetic circuit, and wherein said at least one additional mass has a total mass of 0.1 to 10 times a mass of said magnetic circuit.

13. The arrangement according to claim 11, wherein said at least one additional mass has a total mass substantially equal to said mass of said magnetic circuit.

14. The arrangement according to claim 11, wherein said at least one additional mass is elastically attached to said drive unit or said frame by one or more of an elastomer, a metal spring, or an air spring.

15. The arrangement according to claim 11, wherein said drive unit includes a magnetic circuit, and wherein said at least one additional mass is elastically attached to said magnetic circuit by at least one spring.

16. The arrangement according to claim 15, wherein said at least one spring includes a plurality of springs arranged in serial between said magnetic circuit and said at least one additional weight.

17. The arrangement according to claim 15, wherein said at least one spring includes a plurality of springs arranged in parallel between said magnetic circuit and said at least one additional weight.

18. The arrangement according to claim 11, wherein said at least one additional mass is elastically attached to said at least one of said driver unit and said frame by at least two springs having relatively different elasticities.

19. The arrangement according to claim 11, wherein said at least one additional mass is elastically attached to said at least one of said driver unit and said frame by at least two springs having substantially equal elasticities.

20. The arrangement according to claim 11, wherein said at least one additional mass is made from a solid material.

* * * * *